United States Patent [19]

Borzak

[11] 4,176,744

[45] Dec. 4, 1979

[54] TAPE REEL CONTAINER

[75] Inventor: Robert A. Borzak, Opelika, Ala.

[73] Assignee: Ampex Corporation, Redwood City, Calif.

[21] Appl. No.: 898,655

[22] Filed: Apr. 21, 1978

[51] Int. Cl.[2] ..... B65D 85/67; B65D 85/671

[52] U.S. Cl. ..... 206/303; 206/310; 206/408; 229/36; 229/2.5 R

[58] Field of Search ..... 206/408, 303, 45.19, 206/45.34, 310; 229/36, 2.5

[56] References Cited

U.S. PATENT DOCUMENTS

| | | | |
|---|---|---|---|
| 2,090,375 | 8/1937 | Rosenthal et al. | 229/36 |
| 3,385,424 | 5/1968 | Thompson et al. | 206/45.19 |
| 3,670,881 | 6/1972 | Dutcher | 206/45.34 |
| 3,685,646 | 8/1972 | Sy | 229/2.5 |
| 4,076,119 | 2/1978 | Clarke | 206/303 |

*Primary Examiner*—William T. Dixson, Jr.

*Attorney, Agent, or Firm*—Robert G. Clay; Charles M. Carman, Jr.

[57] ABSTRACT

A tape reel container of the flat-walled box type holding a reel-supporting tray. The periphery of the tray is formed with a downward and outwardly facing step confronting the side walls of the container, and the side walls are formed with inward and downwardly folding flaps engaging the tray step, so as to both retain and be retained by the tray.

9 Claims, 4 Drawing Figures

TAPE REEL CONTAINER

BACKGROUND OF THE INVENTION

This invention relates to reel containers, and particularly to such containers having reel-supporting inserts.

Previously in the art, reels have been stored and shipped in containers of widely varying types, but including particularly the flat-walled box type with at least one interior reel-supporting hub.

However, the manufacture of all such prior art containers has required the bonding or fitting together of various complex members made either of metal, plastic, rubber or paperboard, requiring expensive machinery installations for automatic and accurate assembly, or being alternatively too complex for accurate hand assembly.

Accordingly, it is an object of the present invention to provide a tape reel container of improved simplicity in manufacture and assembly.

It is another object of the invention to provide a tape reel container as above described and requiring no adhesives, bonding techniques or fasteners for assembly and use.

THE DRAWINGS

DESCRIPTION OF THE PREFERRED EMBODIMENT

Figure 1:
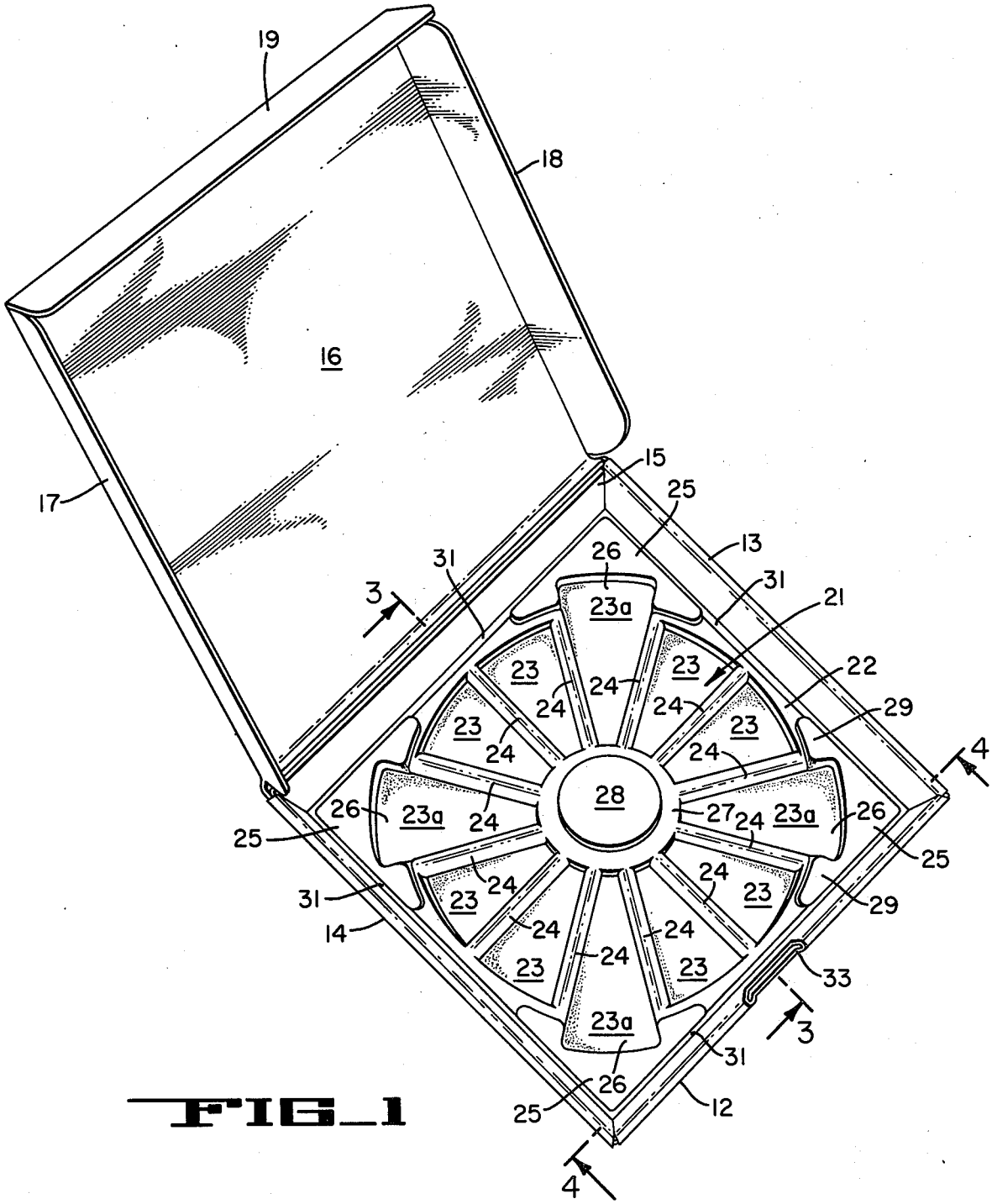
FIG. 1 is a perspective view showing the reel container of the invention in open condition.

Referring now to the drawing, there is shown a rectangular reel container of the one-piece corrugated paperboard type, comprising a flat bottom wall 11 (FIGS. 2–4), a front wall 12, a pair of side walls 13 and 14, a back wall 15, a folding cover 16, cover side flaps 17 and 18, and a cover front flap 19. For holding the reel (not shown) in a centralized position securely in the container, but yet comparatively free to rotate in the container so as to avoid "cinching" or transverse creasing of the tape, there is provided a molded, low-friction plastic tray 21. As is well known in the magnetic tape and cinema film art, a standard reel having an axial hub and two generally circular side flanges, and mounting a tape or film wound thereon, may be shipped by mail in a protective container, but preferably should not be tightly enclosed in the container so as not to be rotatable therein. It has been found that during the rough handling to which the container may be subjected during travel, an outer part of the tape coil may rotate upon the reel even though the reel itself and the inner part of the tape coil is securely held in the box; such differential rotation of portions of the tape coil then causes the formation of overlapping S-shaped folds of tape within the tape coil, together with transverse creases and other damage to the tape. To obviate this problem, it is common practice to provide a central spindle or arbor structure in the container, dimensioned for only loosely fitting within the standard reel hub opening, together with ribbed supporting structure confronting the reel flanges to reduce frictional contact between the container and flanges, the whole being made of low-friction material such as low-friction molded plastic.

Accordingly, the container of the present invention is provided with such a low-friction plastic tray 21, in which the side of the reel may be supported upon a narrow peripheral surface 22, on radially-extending ribs 24, which are separated by depressions 23, 23*a*, and upon an inner peripheral surface 27, from which rises a central reel arbor portion 28. Extra protection for the flange peripheries of the reel is provided at the four corners of the container, as by means of raised corner portions 25 and 29, so that the reel remains undamaged even if the box is subjected to severe impact causing damage to the reel hub. Also, hand access recesses 26 are provided in corner portions 25. The recesses 26 extend inwardly into the corner depressions 23*a* previously mentioned, and outwardly beyond the periphery of the reel, so as to facilitate slipping the fingers beneath the reel for grasping and removing it. It will be understood that, particularly with tape of a width in the neighborhood of two inches, the tape pack is so heavy that damage to the reel can result if it is attempted to lift the reel by one flange alone. The alternative, in prior art containers, has usually been to turn the box upside-down and drop the reel out, also a risky procedure. In the present invention this problem is overcome because recesses 26 permit access of the operator's fingers entirely beneath both flanges of the reel, inasmuch as the reel is supported on tray portions 22 and 24, while recesses 26 go below this level to the level of recesses 23, 23*a*.

Figure 3:
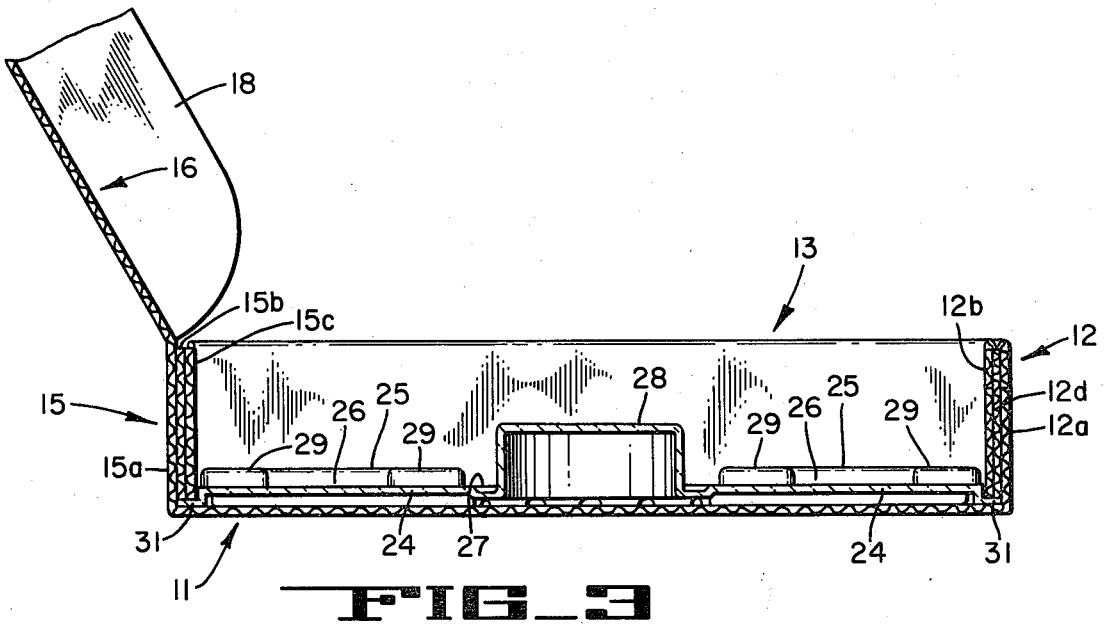
FIG. 3 is an enlarged fragmented cross-sectional elevation view of the container, taken on the plane of lines 3—3 of FIG. 1.
Figure 4:
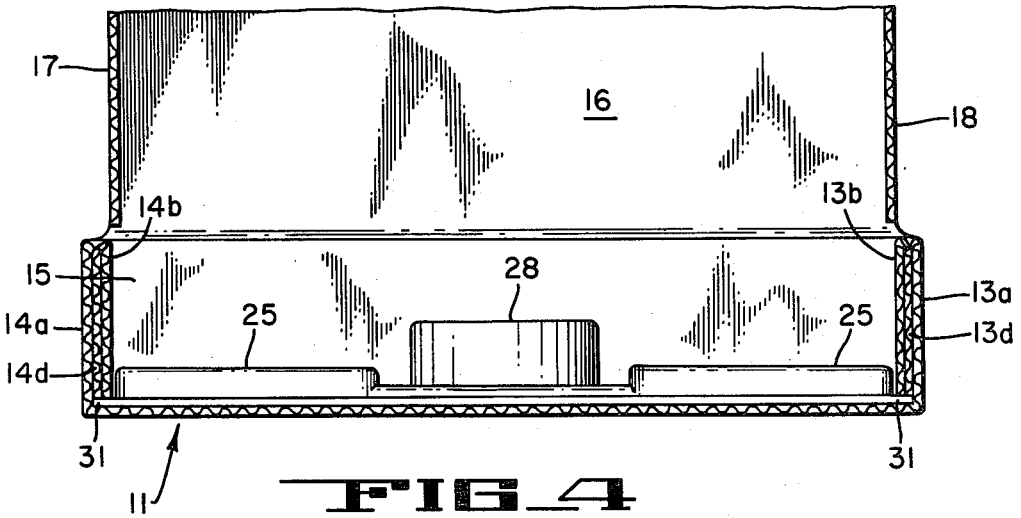
FIG. 4 is a fragmented cross-sectional elevation view of the container, to the same scale as FIG. 3, and taken on the plane of lines 4—4 of FIG. 1.

As a particular feature of the invention, the front wall 12, and sides 13, 14 are formed with inwardly and downwardly folding flap portions 12*b*, 13*b* and 14*b*, respectively, terminating near the bottom wall 11, see FIGS. 3 and 4; and the periphery of the plastic tray 21 is formed with a downwardly and outwardly facing step 31, confronting the walls 12, 13 and 14; and the lower edges of the flaps 12*b*, 13*b* and 14*b* snugly overlie the lowest and most peripheral portion of the step 31, so as to retain the tray securely in the container. Likewise, the step 31 of the tray is in part defined by the adjacent outwardly facing walls of the support portions 29, 22 and 25 of the tray, and these portions are of sufficient height, and are spaced closely enough to the flaps 12*b*, 13*b* and 14*b* that the flaps in turn are retained securely by the step 31 and cannot be unfolded so as to release the tray and disassemble the container.

It will be readily recognized that with such interlocking step 31 and flap portions, the container may be simply and inexpensively hand-folded and snap-fitted together, without the need for adhesives or of fasteners of any sort, and with little chance for error. Also, the avoidance in the present invention of adhesives and fasteners minimizes debris in the final package, and resultant debris-caused drop-outs on the tape.

Figure 2:
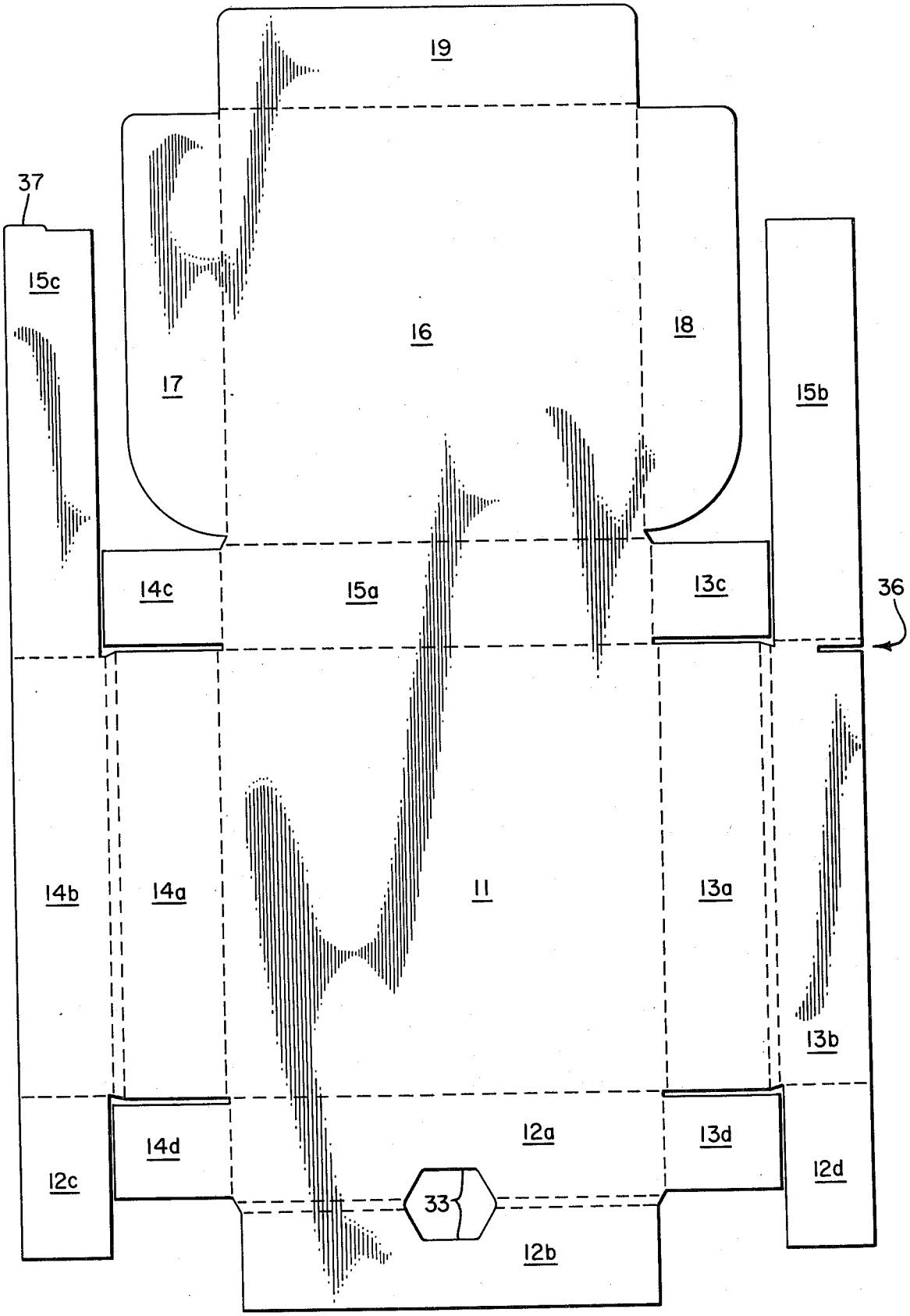
FIG. 2 is a plan view of a corrugated paperboard blank used in the manufacture of the container of FIG. 1.

FIG. 2 shows the form of the corrugated paperboard blank from which the container is folded. To make the box, portions 13*c*, 13*d*, 14*c* and 14*d* are folded 90° upwardly (from the plane of the drawing sheet); portions 12*c*, 12*d*, 15*b* and 15*c* are folded 90° downwardly; then the tray 21 is fitted onto bottom 11, and portions 12*a*, 13*a*, 14*a* and 15*a* are folded 90° upwardly with portions 13*d*, 14*d*, 13*c* and 14*c* being fitted against the adjacent inner faces of portions 13*a* and 14*a*; then portions 13*b* and 14*b* are folded inwardly and downwardly to register against the adjacent inner faces of portions 13*a*, 13*c*, 13*d* and 14*a*, 14*c*, 14*d*, respectively, the outer edges of portions 13*b* and 14*b* being snap-fitted into the step 31 of the tray, and with portion 15*c* lying inwardly of portion 15*b* and tap 37 of portion 15*c* being snap-fitted into slot 36 of portion 13*b*; and finally, portion 12*b* is folded downwardly and inwardly to snap-fit into the tray step 31, leaving opening 33 as an access opening to the cover 16, flaps 17, 18, 19 of which are also folded 90° inwardly.

Thus, there has been described a tape reel container of the flat-walled box type holding a reel supporting tray. The periphery of the tray is formed with a downward and outwardly facing step confronting the side walls of the container, and the side walls are formed with inward and downwardly folding flaps engaging the tray step, so as to both retain and be retained by the tray.

What is claimed is:

1. A tape reel container of the flat-walled box type having a reel supporting tray portion, characterized in that;

at least two diametrically opposite parts of the periphery of said tray portion are formed with steps having downward and outwardly facing portions confronting corresponding portions of opposite side walls of said container;

said corresponding portions of said side walls are each formed with an inward and downwardly folding flap snugly engaging said tray step, so as to both retain and be retained by said tray portion; and said tray portion is dimensioned with respect to said box so that said outwardly facing portions of the tray laterally engage and are snugly bracketed by said corresponding portions of the opposite sides and said tray is securely retained by said flaps against removal excepting as by convex upwardly bowed flexing of the entire tray and particularly the middle portion thereof.

2. A tape reel container as recited in claim 1, wherein said tray portion has:

a central arbor portion dimensioned for engaging and supporting said reel against substantial radial motion; and a plurality of circumferentially-distributed ridges extending radially from said arbor portion for engaging and supporting one side of said reel with a minimum of friction.

3. A tape reel container as recited in claim 2, wherein said ridges define fan-shaped recesses therebetween, and the corner portions of said tray define extensions of the adjacent fan-shaped recesses to a radius substantially greater than that of the reel, so as to provide access to the space beneath the reel, thus facilitating the grasping of the entire reel by the fingers of an operator.

4. A tape reel container as recited in claim 2 or claim 3, wherein the corners of said tray portion are formed with reel-supporting portions extending axially above said ridges for supporting said reel against radial motion in excess of that permitted by said arbor.

5. A tape reel container as recited in claim 1, wherein said container is a substantially rectangular box having a back, a folding front cover, three side walls, and a spine wall extending between said front cover and back, said tray portion having said downwardly and outwardly formed step confronting at least all three of said side walls, and said side walls each being formed with one of said flaps.

6. A tape reel container as recited in claim 5, wherein each of said side walls has a first corner tab extending toward each adjacent side wall and fitting snugly between that adjacent side wall and the flap thereof.

7. A tape reel container as recited in claim 6, wherein each of the side walls adjacent said spine has a second corner tab extending across the entire inner face of said spine, said tray portion being formed with said step also confronting said spine and second tabs.

8. A tape reel container as recited in claim 7, wherein the innermost of said second tab has a third tab extending from the free end thereof on the side of said free end adjacent the back of said box, and fitting into a conforming slot formed in the adjacent side wall flap, so as to lock said last-named second tab securely in assembled position.

9. A tape reel container as recited in claim 8, wherein said cover has three extending cover flaps formed on the three edges thereof other than the spine edge and folding downwardly and fitting snugly within and adjacent the three corresponding side wall flaps of said box.

* * * * *